US012251024B2

(12) United States Patent
Balinbin

(10) Patent No.: US 12,251,024 B2
(45) Date of Patent: Mar. 18, 2025

(54) SYSTEMS AND METHODS FOR A RAISED BED

(71) Applicant: SAGE PEGASUS IP HOLDINGS LLC, Denver, CO (US)

(72) Inventor: William M. Balinbin, Denver, CO (US)

(73) Assignee: SAGE PEGASUS IP HOLDINGS LLC, Denver, CO (US)

( * ) Notice: Subject to any disclaimer, the term of this patent is extended or adjusted under 35 U.S.C. 154(b) by 258 days.

(21) Appl. No.: 17/861,128

(22) Filed: Jul. 8, 2022

(65) Prior Publication Data

US 2023/0019273 A1 Jan. 19, 2023

Related U.S. Application Data

(60) Provisional application No. 63/221,416, filed on Jul. 13, 2021.

(51) Int. Cl.

| | |
|---|---|
| ***A47C 19/20*** | (2006.01) |
| ***A47C 17/38*** | (2006.01) |
| ***A47C 17/62*** | (2006.01) |
| *A47C 19/22* | (2006.01) |

(52) U.S. Cl.

CPC ..... *A47C 17/62* (2013.01); *A47C 17/38* (2013.01); *A47C 19/22* (2013.01)

(58) Field of Classification Search

CPC ..... A47C 17/38; A47C 17/48; A47C 17/52; A47C 17/58; A47C 17/62; A47C 17/86; A47C 17/869; A47C 19/22; A47C 19/005; A47C 19/20; A47C 19/207; A47D 7/007

See application file for complete search history.

(56) References Cited

U.S. PATENT DOCUMENTS

| | | | | |
|---|---|---|---|---|
| 2,787,007 | A * | 4/1957 | Erdkamp | A47D 7/007 5/2.1 |
| 3,769,502 | A * | 10/1973 | Schultz | A47C 21/00 362/228 |
| 4,109,328 | A * | 8/1978 | Mason | A47C 19/20 5/8 |
| 4,110,854 | A * | 9/1978 | Sjolie | A47C 27/085 5/915 |
| 4,253,204 | A * | 3/1981 | Tasaka | A47C 19/207 5/2.1 |

(Continued)

OTHER PUBLICATIONS

Cinius Arredamento, SpazioBed, Oct. 11, 2019, Facebook.com, Video, https://www.facebook.com/CINIUS.ARREDAMENTI/videos/spaziobed/2308677109384250/ (Year: 2019).*

(Continued)

*Primary Examiner* — Justin C Mikowski
*Assistant Examiner* — Ifeolu A Adeboyejo
(74) *Attorney, Agent, or Firm* — Holland & Hart LLP

(57) ABSTRACT

A raised bed system includes a plurality of modules assembled to form a raised platform for supporting a bed. The plurality of modules define a storage area beneath the raised platform and the bed and include a closet module and a desk module. The closet module defines a closet positioned in the storage area. The desk module is positioned in the storage area and includes a movable desk selectively movable between a stored configuration and a deployed configuration.

16 Claims, 19 Drawing Sheets

(56) References Cited

U.S. PATENT DOCUMENTS

| | | | | |
|---|---|---|---|---|
| 4,259,755 | A * | 4/1981 | Hollander | A47C 13/005 5/2.1 |
| 6,398,323 | B1 * | 6/2002 | Lee | A47C 17/86 312/321 |
| 6,785,920 | B1 * | 9/2004 | Amador, Jr. | A47C 17/86 5/400 |
| 7,942,485 | B2 * | 5/2011 | Castelluccio | A47B 87/00 312/195 |
| 2003/0070224 | A1 * | 4/2003 | Walsh | A47C 19/22 5/2.1 |
| 2018/0199711 | A1 * | 7/2018 | Miller | E02B 15/10 |
| 2022/0273108 | A1 * | 9/2022 | Swearingen | A47C 17/62 |
| 2023/0046903 | A1 * | 2/2023 | Cordell | A47C 19/022 |

OTHER PUBLICATIONS

Cuckooland, Vox Nest, Sep. 27, 2020, Cuckooland.com, https://www.cuckooland.com/brand/vox/nest, https://www.cuckooland.com/brand/vox/nest-kids-cabin-bed-in-larch-effect-and-graphite (Year: 2020).*

* cited by examiner

SYSTEMS AND METHODS FOR A RAISED BED

CROSS REFERENCE TO RELATED APPLICATIONS

This application claims priority to and the benefit of U.S. Provisional Patent Application No. 63/221,416, entitled "SYSTEMS AND METHODS FOR A RAISED BED," filed Jul. 13, 2021, the disclosure of which is hereby incorporated by reference in its entirety.

TECHNICAL FIELD

The present disclosure relates generally to beds, and more particularly to a raised bed for a housing unit.

BACKGROUND

Real estate prices continue to rise, increasing living costs for households, increasing costs for builders and contractors, increasing costs for landlords, and reducing profits for builders, contractors, and landlords. To compensate for these increased costs, builders, contractors, and landlords have been building smaller dwellings to increase the number of dwellings per unit area, increasing the number of dwellings sold or rented per unit area. At least some of these dwellings include multiple housing units within the dwelling (apartments, hotels, condominiums, extended stay hotels, etc.). Reducing the area of these housing units reduces the overall space for amenities within the housing unit that a household needs to function. In some cases, the housing units are constructed without needed amenities. Furniture may be designed to have dual or multiple purposes such that some of the amenities are incorporated into the furniture of the dwelling. Specifically, there exists a need for furniture that has a primary function and also incorporates one or more amenities of a household to ensure the household includes all the needed amenities.

SUMMARY

One aspect of the present disclosure is directed to a raised bed system including a plurality of modules assembled to form a raised platform for supporting a bed. The plurality of modules define a storage area beneath the raised platform and the bed and include a closet module and a desk module. The closet module defines a closet positioned in the storage area. The desk module is positioned in the storage area and includes a movable desk selectively movable between a stored configuration and a deployed configuration.

Another aspect of the present disclosure relates to a method of assembling a raised bed system. The method includes positioning a storage module in a room. The storage module defines a storage compartment. The method also includes attaching a first closet module to the storage module. The first closet module defines a first closet. The method further includes attaching a second closet module to the first closet module. The second closet module defines a second closet. The method also includes attaching a desk module to the second closet module. The desk module includes a movable desk selectively movable between a stored configuration and a deployed configuration. The storage module, the first closet module, the second closet module, and the desk module form a raised platform for supporting a bed.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label.

Figure 1:
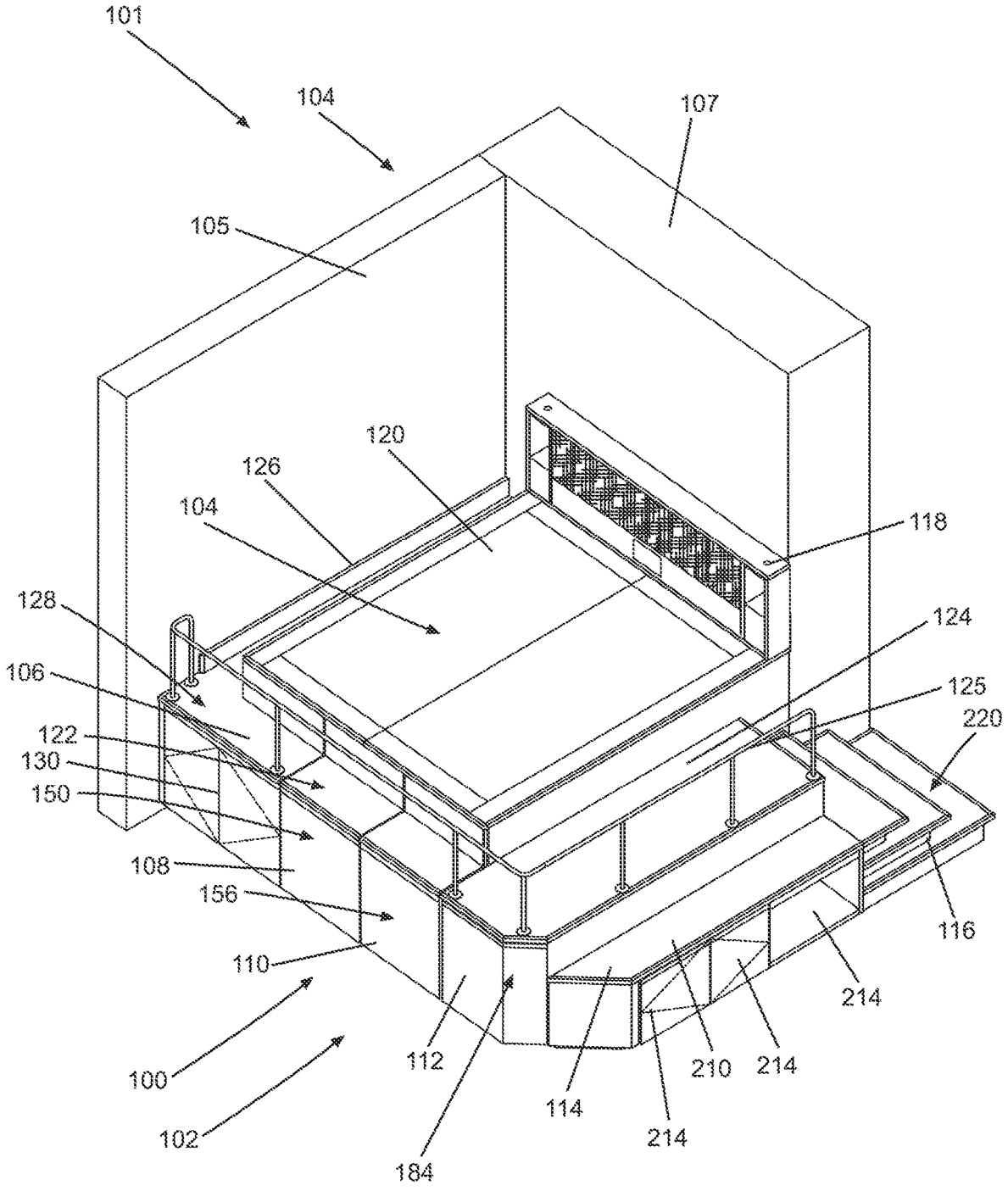
FIG. 1 is a perspective schematic view of a raised bed unit within a housing unit in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

This description provides examples, and is not intended to limit the scope, applicability or configuration of the invention. Rather, the ensuing description will provide those skilled in the art with an enabling description for implementing embodiments of the invention. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, and devices may individually or collectively be components of a larger system, wherein other procedures may take precedence over or otherwise modify their application.

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

This description provides dimensions of various aspects of the embodiments described herein. The provided dimensions are specific examples of measurements that may vary and are not intended to limit the scope, applicability or configuration of the embodiments described herein. Rather, the dimensions will provide those skilled in the art with an enabling description for implementing embodiments of the invention. Various changes may be made to the dimension such that the dimensions vary.

Figure 2:
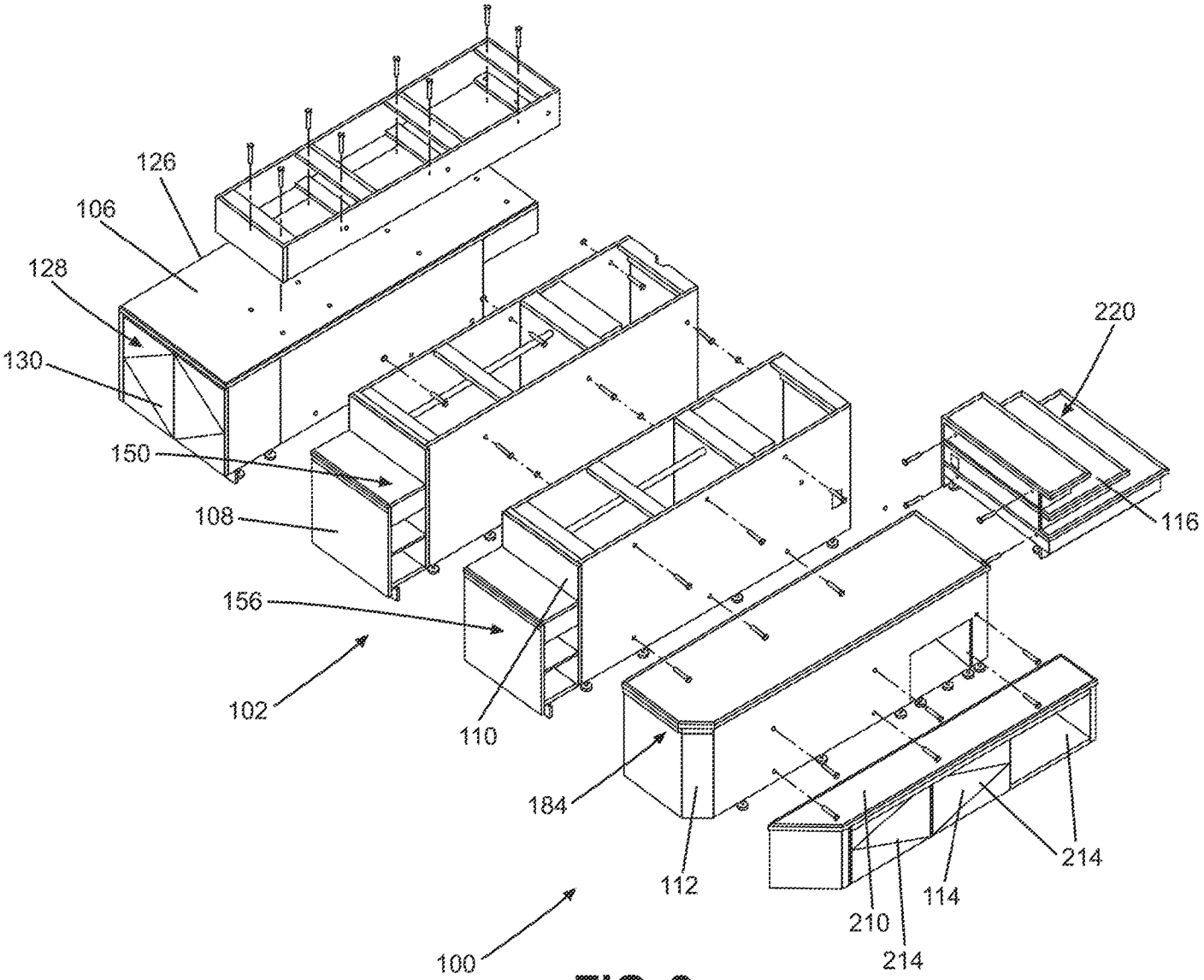
FIG. 2 is an exploded view of the raised bed unit illustrated in FIG. 1 in accordance with the present disclosure.
Figure 3:
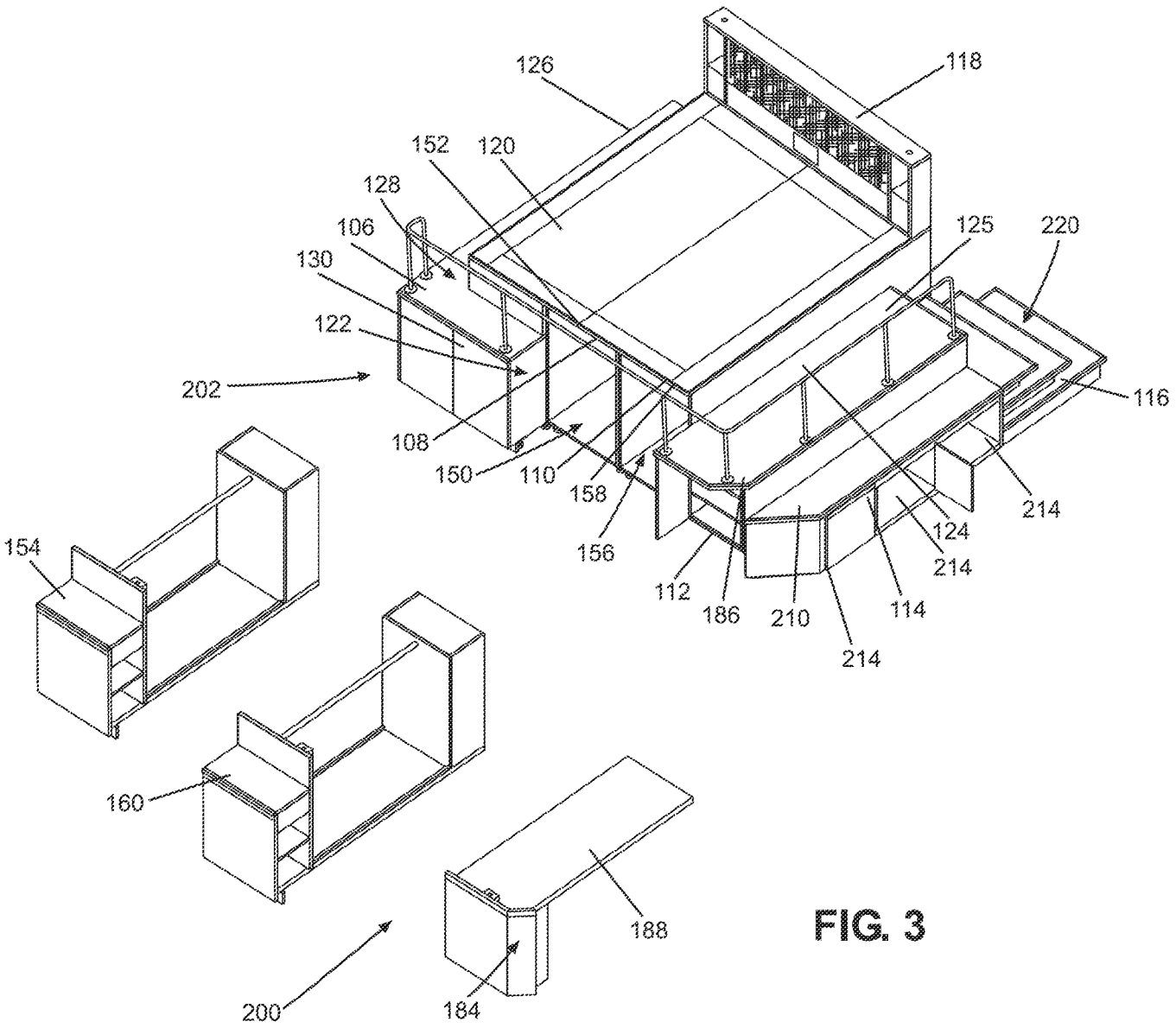
FIG. 3 is a perspective view of the raised bed unit illustrated in FIGS. 1 and 2 with portions of the raised bed unit removed in accordance with the present disclosure.

FIG. 1 is a perspective schematic view of a raised bed unit 100 within a housing unit 101. FIG. 2 is an exploded view of the raised bed unit 100. FIG. 3 is a perspective view of the raised bed unit 100 with portions of the raised bed unit 100 removed. The raised bed 100 described herein elevates a bed 104 and provides two closets, a storage area, and a desk in the area below the raised bed. Elevating the bed 104 and providing amenities below the elevated bed 104 enables smaller dwellings or housing units to include those amenities without increasing the total area of the housing unit or dwelling. Accordingly, the raised bed unit 100 described herein enables a contractor, builder, or landlord to build, sell, or rent smaller dwellings or housing units while still providing amenities necessary for a household to function.

The raised bed unit 100 includes of a plurality of modules 102 attached to each other and the bed 104 positioned on the modules 102. The modules 102 include a storage module 106, a first closet module 108, a second closet module 110, a desk module 112, a bench module 114, a stair module 116, and a headboard 118. The modules 102 are attached to each other to form the raised bed unit 100 and to define a raised platform 120, a storage area 122 beneath the raised platform 120, a walking path 124 around the raised platform 120, and a handrail 125 attached to the raised platform 120 around the walking path 124. The raised platform 120 supports the bed 104, and the storage area 122 stores components of the storage module 106, the first closet module 108, the second closet module 110, and the desk module 112 as described herein.

As shown in FIG. 2, the raised bed unit 100 is constructed using a modular construction process where each of the modules 106-118 are individually constructed or prefabricated. The modules 106-118 are then individually transported to the dwelling or housing unit and assembled into the raised bed unit 100. The modular construction process reduces the overall cost of the raised bed unit 100 because each of the modules 106-118 can be mass produced at a manufacturing facility. Additionally, the modular construction process enables the raised bed unit 100 to be quickly assembled within the dwelling or housing unit by simply attaching the modules 106-118 together, reducing furnishing and construction costs for the contractor and builder. Finally, the modular construction process increases the quality of the finished raised bed unit 100 by standardizing the process of manufacturing the raised bed unit 100.

The modular construction process includes manufacturing each of the modules 106-118 individually at a manufacturing facility and transporting the modules 106-118 to the dwelling or housing unit. The modular construction process then includes transporting the modules 106-118 individually into the dwelling or housing unit through an entrance (door or window) of the dwelling or housing unit. As described herein, the modules 106-118 are designed to fit through a standard size front door of a dwelling or housing unit. The modular construction process also may include attaching one or more to the modules 106-118 to one or more walls 103 for stability. Finally, the modular construction process includes assembling the modules 106-118 into the raised bed unit 100 as described herein.

Figure 4:
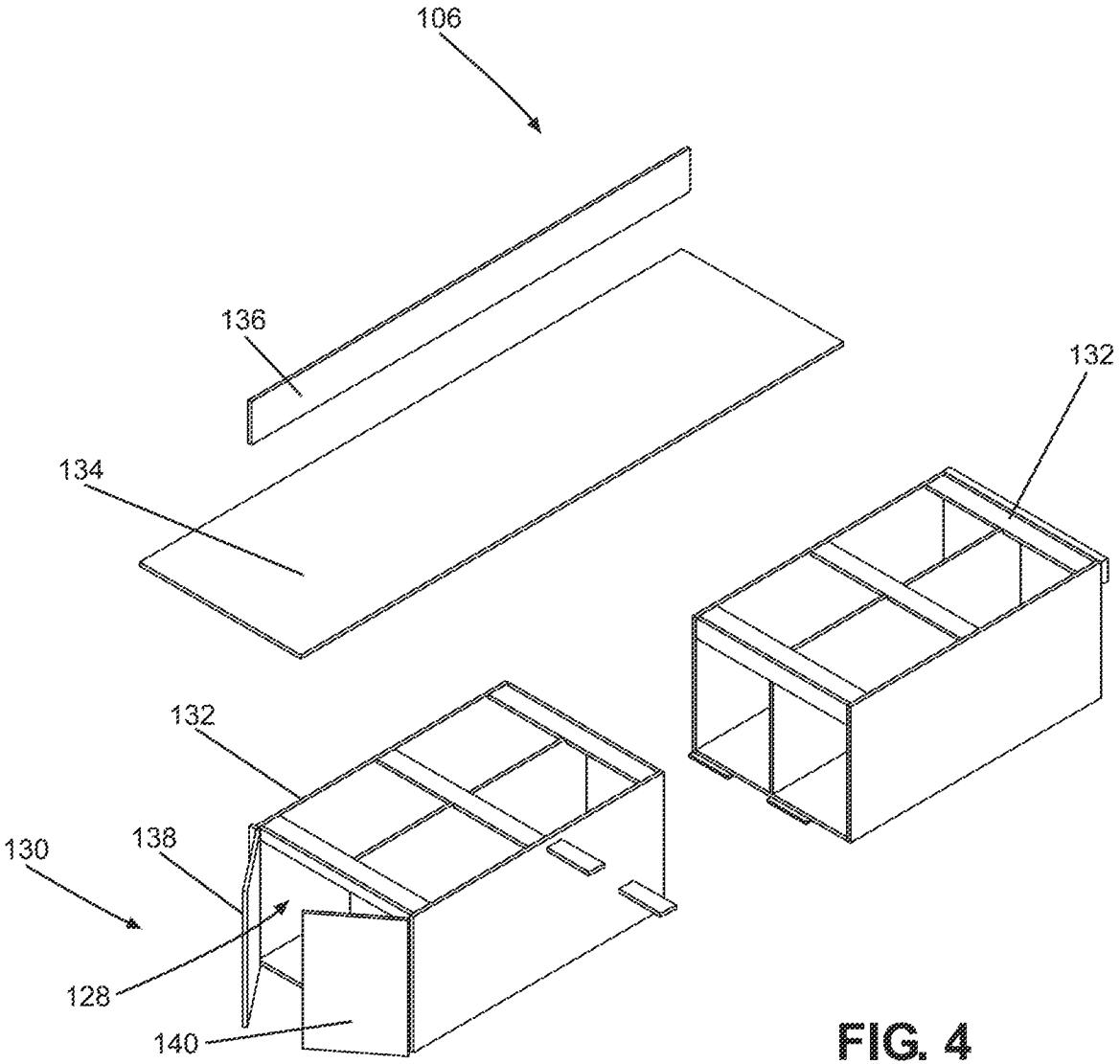
FIG. 4 is a perspective view of a storage module of the raised bed unit illustrated in FIGS. 1-3 broken up into additional modules in accordance with the present disclosure.
Figure 5:
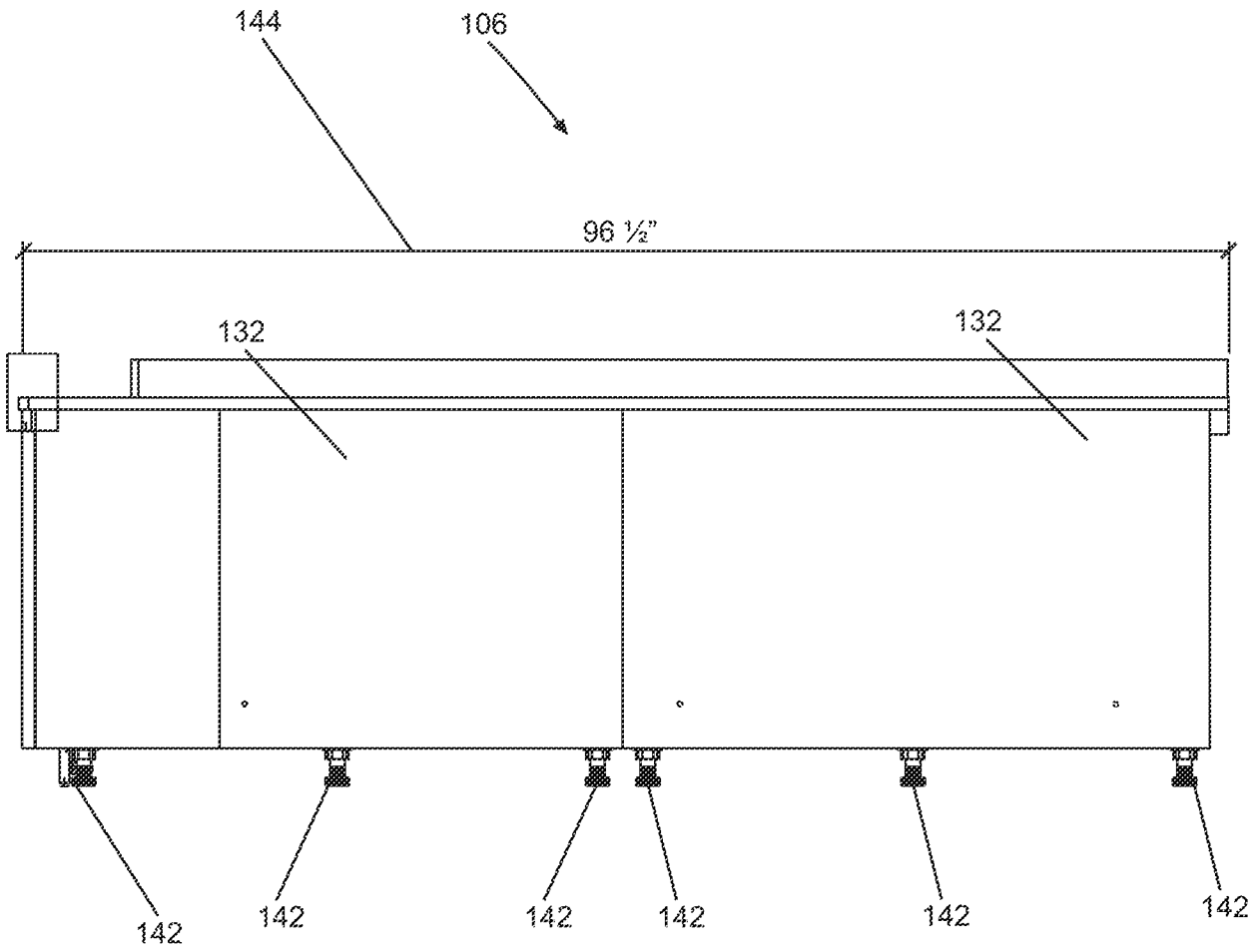
FIG. 5 is a side schematic view of the storage module illustrated in FIGS. 1-4 in accordance with the present disclosure.
Figure 6:
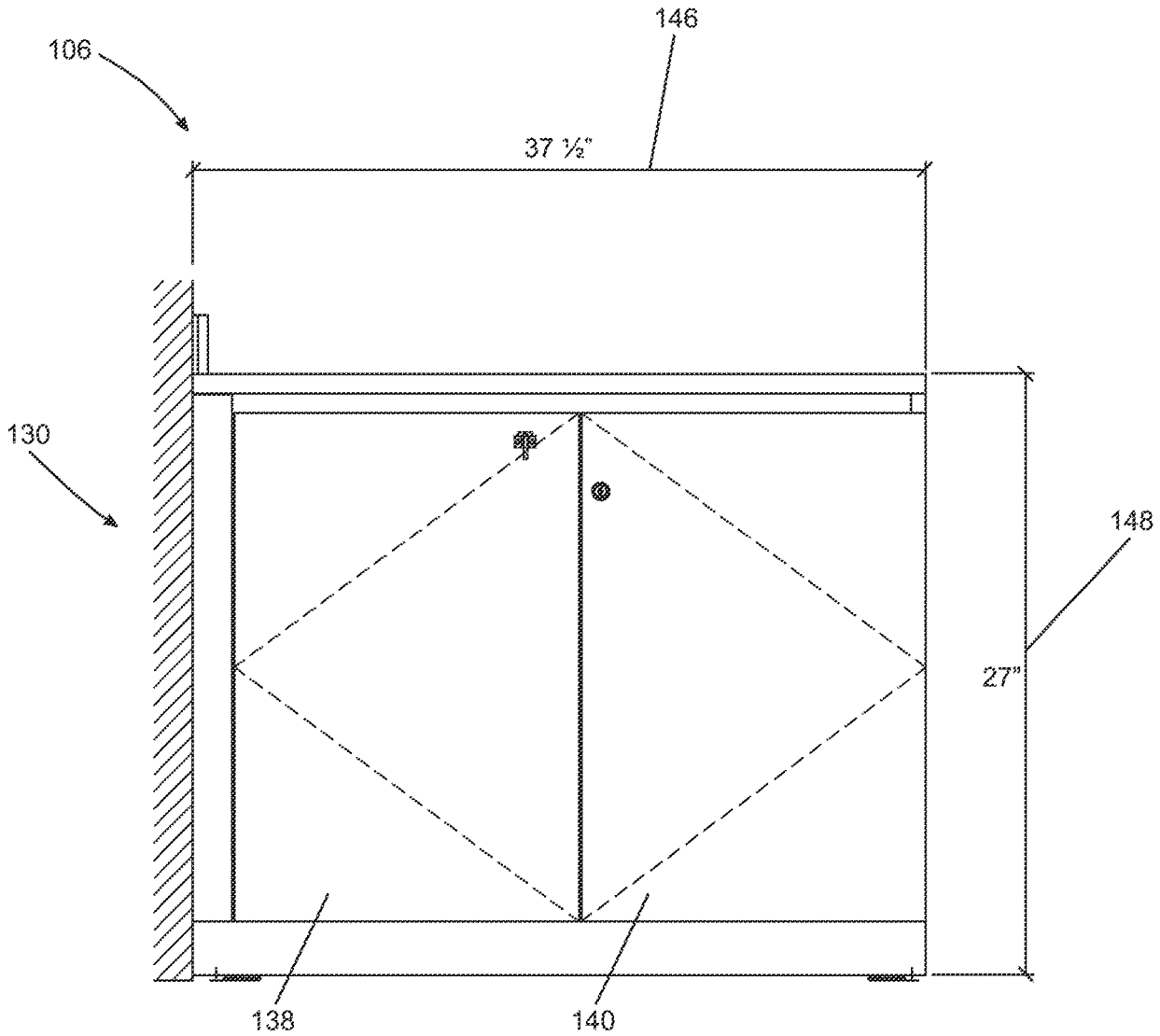
FIG. 6 is a front schematic view of the storage module illustrated in FIGS. 1-5 in accordance with the present disclosure.

FIG. 4 is a perspective view of the storage module 106 broken up into additional modules. FIG. 5 is a side schematic view of the storage module 106. FIG. 6 is a front schematic view of the storage module 106. As shown in FIG. 1, the storage module 106 is positioned proximate a first wall 105 and a second wall 107 of the housing unit 101 and forms a first edge 126 of the raised bed unit 100. The storage module 106 may be attached to the first wall 105 and the second wall 107 for additional stability. The storage module 106 defines a storage compartment 128 at least partially within the storage area 122 beneath the raised platform 120. The storage module 106 includes at least one door 130 for access to the storage compartment 128.

As shown in FIG. 4, the storage module 106 may be split up into two additional modules 132 and may also include a top 134 and a sideboard 136. The splitting up the storage module 106 allows the storage module 106 to be easily transported into the housing unit 101 through an entrance. Additionally, as shown in FIGS. 5 and 6, the storage module 106 includes two doors 130, a first door 138 and a second door 140, that enable selective entry into the storage compartment 128. The storage module 106 also include a plurality of adjustable feet 142 to enable the storage module 106 and the raised bed unit 100 to be leveled during construction and assembly. The assembled storage module 106 has storage module length 144, a storage module width 146, and a storage module height 148. In the illustrated embodiment, the storage module length 144 is about 96.5 inches, the storage module width 146 is about 37.5 inches, and the storage module height 148 is about 43.5 inches. In alternative embodiments, the storage module length 144, the storage module width 146, and the storage module height 148 may be any lengths that enable the storage module 106 to operate as described herein. In the illustrated embodiment, the storage compartment 128 extends the entire length 144 of the storage module 106 to maximize storage volume. In alternative embodiments, the storage compartment 128 only extends part of the length 144 of the storage module 106.

The first closet module 108 is positioned proximate the storage module 106 and the second wall 107 and is attached to the storage module 106 and the second closet module 110 for stability. The first closet module 108 may also be attached to the second wall 107 for additional stability. The first closet module 108 defines a first closet 150 at least partially positioned in the storage area 122 in a stored configuration. The first closet module 108 includes a first closet shell 152 and a first movable closet platform 154 selectively movable between the stored configuration and a deployed configuration. In the stored configuration, the first movable closet platform 154 is positioned within the first closet shell 152 and the storage area 122 beneath the raised platform 120. In the deployed configuration, the first movable closet platform 154 is positioned out of the first closet shell 152 and the storage area 122.

Similarly, the second closet module 110 is positioned proximate the first closet module 108 and the second wall 107 and is attached to the first closet module 108 and the desk module 112 for stability. The second closet module 110 may also be attached to the second wall 107 for additional stability. The second closet module 110 defines a second closet 156 at least partially positioned in the storage area 122 in a stored configuration. The second closet module 110 includes a second closet shell 158 and a second movable closet platform 160 selectively movable between the stored configuration and a deployed configuration. In the stored configuration, the second movable closet platform 160 is positioned within the second closet shell 158 and the storage area 122 beneath the raised platform 120. In the deployed configuration, the second movable closet platform 160 is positioned out of the second closet shell 158 and the storage area 122.

Figure 7:
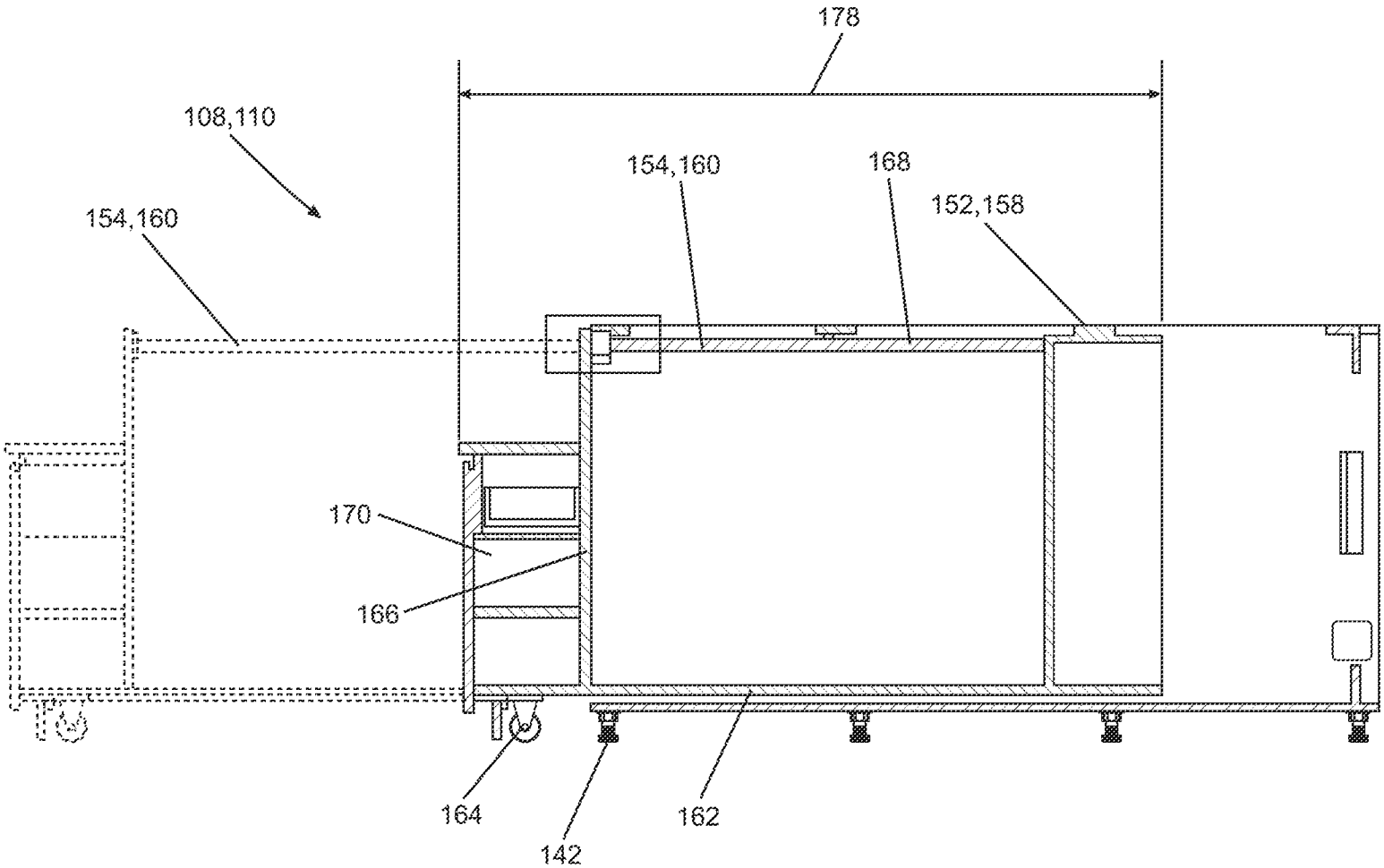
FIG. 7 is a side schematic view of the first and second closet modules of the raised bed unit illustrated in FIGS. 1-3.
Figure 8:
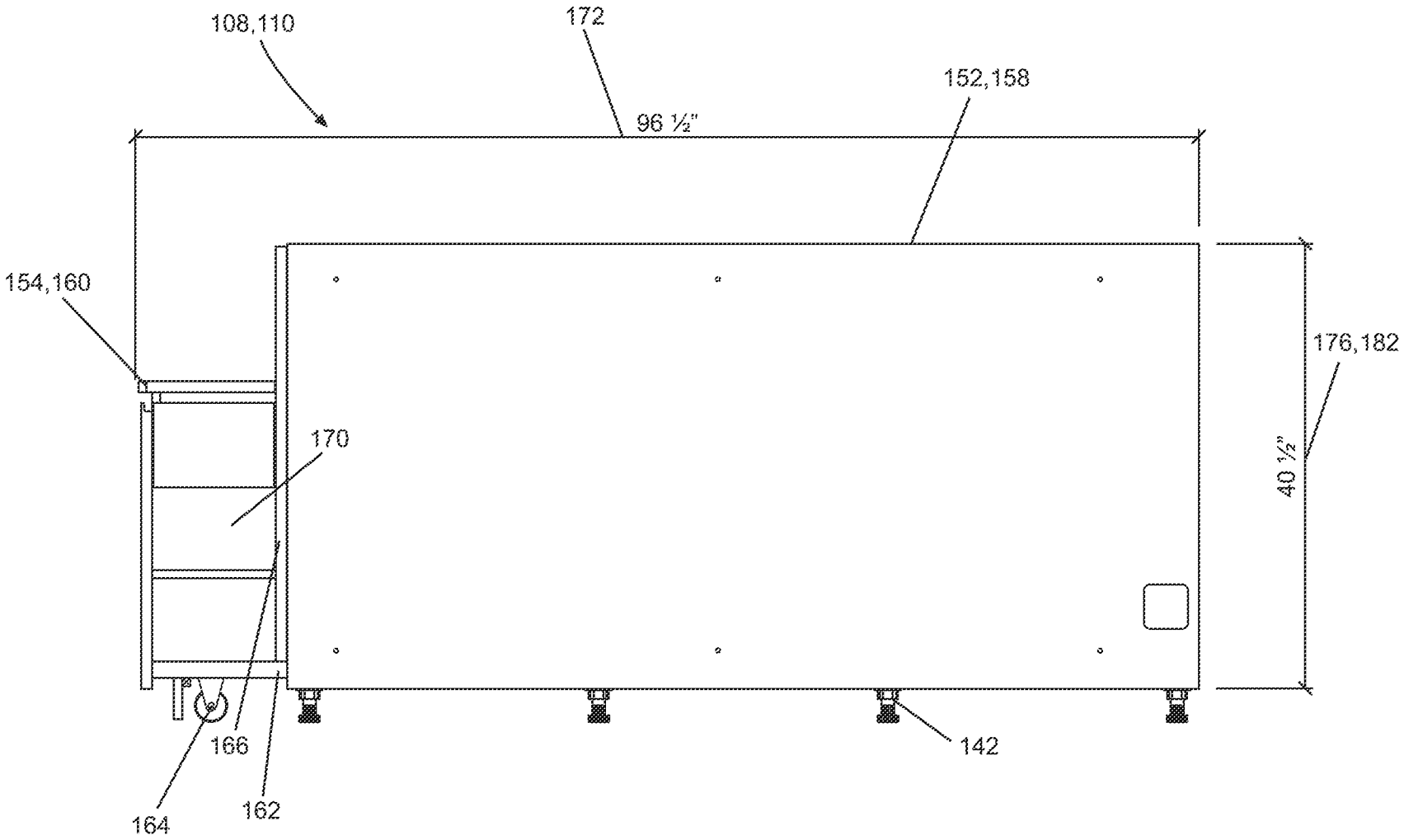
FIG. 8 is another side schematic view of the first and second closet modules illustrated in FIG. 7 in accordance with the present disclosure.
Figure 9:
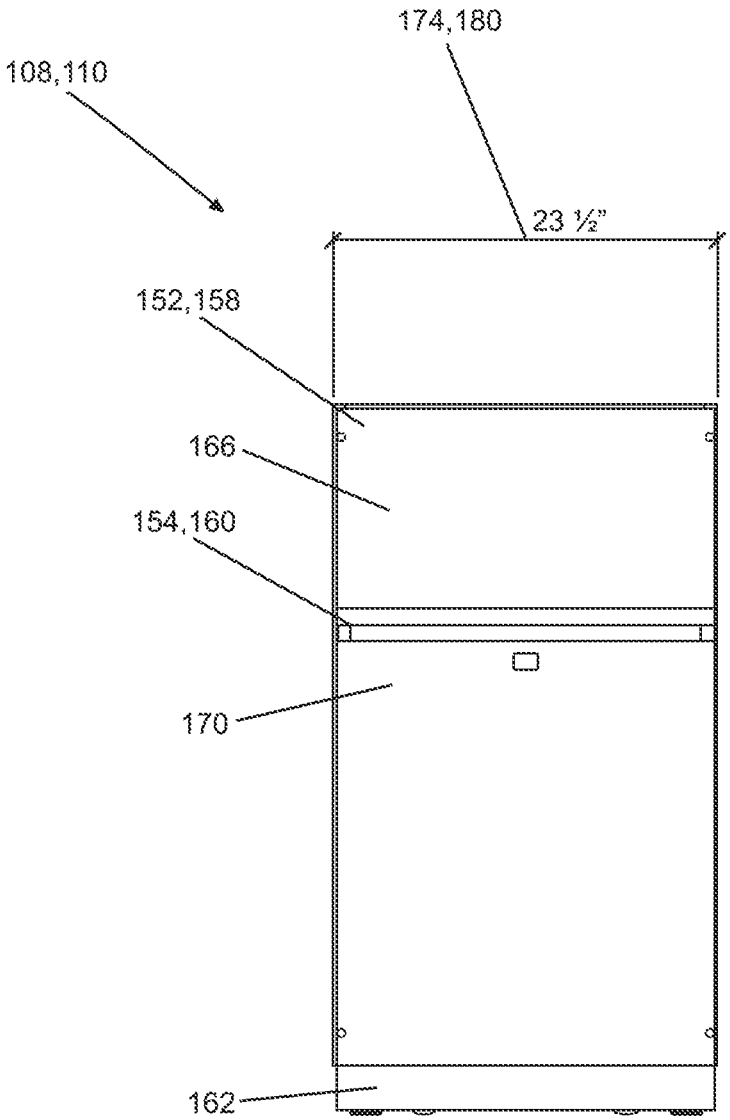
FIG. 9 is a front schematic view of the first and second closet modules illustrated in FIGS. 7 and 8 in accordance with the present disclosure.
Figure 10:
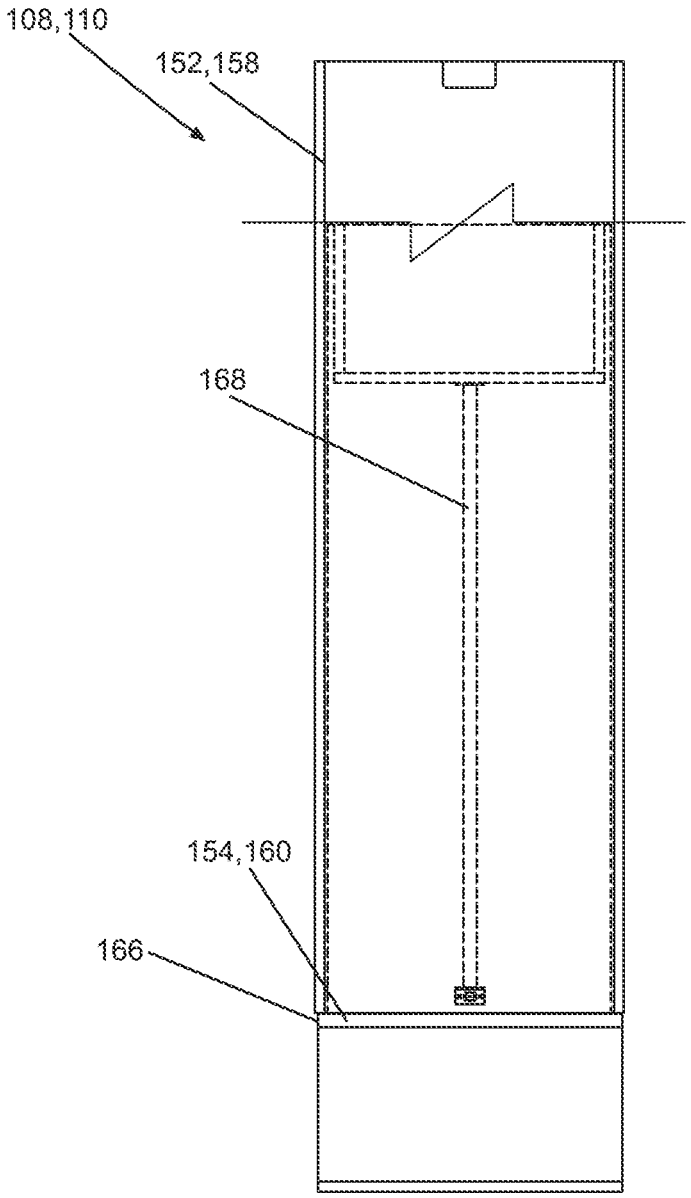
FIG. 10 is a top schematic view of the first and second closet modules illustrated in FIGS. 7-9 in accordance with the present disclosure.

In the illustrated embodiments, the first and second closet modules 108 and 110 are substantially identical and FIGS. 7-10 describe both the first and second closet modules 108 and 110. FIG. 7 is a side schematic view of the first and second closet modules 108 and 110 with portions of the first and second movable closet platforms 154 and 160 shown in phantom to illustrate the first and second movable closet platforms 154 and 160 pulled out of the first and second closet shells 152 and 158. FIG. 8 is another side schematic view of the first and second closet modules 108 and 110. FIG. 9 is a front schematic view of the first and second closet modules 108 and 110. FIG. 10 is a top schematic view of the first and second closet modules 108 and 110.

As shown in FIGS. 7-10, the first and second movable closet platforms 154 and 160 are configured to be pulled out the first and second closet shells 152 and 158 and pushed into the first and second closet shells 152 and 158 to enable access to the first and second closets 150 and 156. The first and second movable closet platforms 154 and 160 each include a base 162, a plurality of wheels 164 attached to the base 162, supports 166 attached to the base 162, a closet rod 168 attached to the supports 166, a plurality of adjustable feet 142 also attached to the base 162, and shelves 170 attached to the base 162 and at least one of the supports 166. The wheels 164 roll the first and second movable closet platforms 154 and 160 between the stored configuration and the deployed configuration, and the adjustable feet 142 support the first and second movable closet platforms 154 and 160 in both the stored configuration and the deployed configuration. The closet rod 168 provides a rod for hanging clothes and the shelves 170 provide additional storage.

The first and second closet modules 108 and 110 each have a closet module length 172, a closet module width 174, and a closet module height 176. In the illustrated embodiment, the closet module length 172 is about 96.5 inches, the closet module width 174 is about 23.5 inches, and the closet module height 176 is about 43.5 inches. In alternative embodiments, the closet module length 172, the closet module width 174, and the closet module height 176 may be any lengths that enable the first and second closet modules 108 and 110 to operate as described herein.

The first and second movable closet platforms 154 and 160 each have a movable closet platform length 178, a movable closet platform width 180, and a movable closet platform height 182. In the illustrated embodiment, the movable closet platform length 178 is about 90.5 inches, the movable closet platform width 180 is about 23.5 inches, and the movable closet platform height 182 is about 43.5 inches. In alternative embodiments, the movable closet platform length 178, the movable closet platform width 180, and the movable closet platform height 182 may be any lengths that enable the first and second movable closet platforms 154 and 160 to operate as described herein.

The desk module 112 is positioned proximate the second closet module 110 and is attached to the second closet module 110 and the bench module 114 for stability. The desk module 112 defines a desk 184 at least partially positioned in the storage area 122 in a stored configuration. The desk module 112 includes a desk shell 186 and a movable desk 188 selectively movable between the stored configuration and a deployed configuration. In the stored configuration, the movable desk 188 is positioned within the desk shell 186 and the storage area 122 beneath the raised platform 120. In the deployed configuration, the movable desk 188 is positioned out of the desk shell 186 and the storage area 122.

Figure 11:
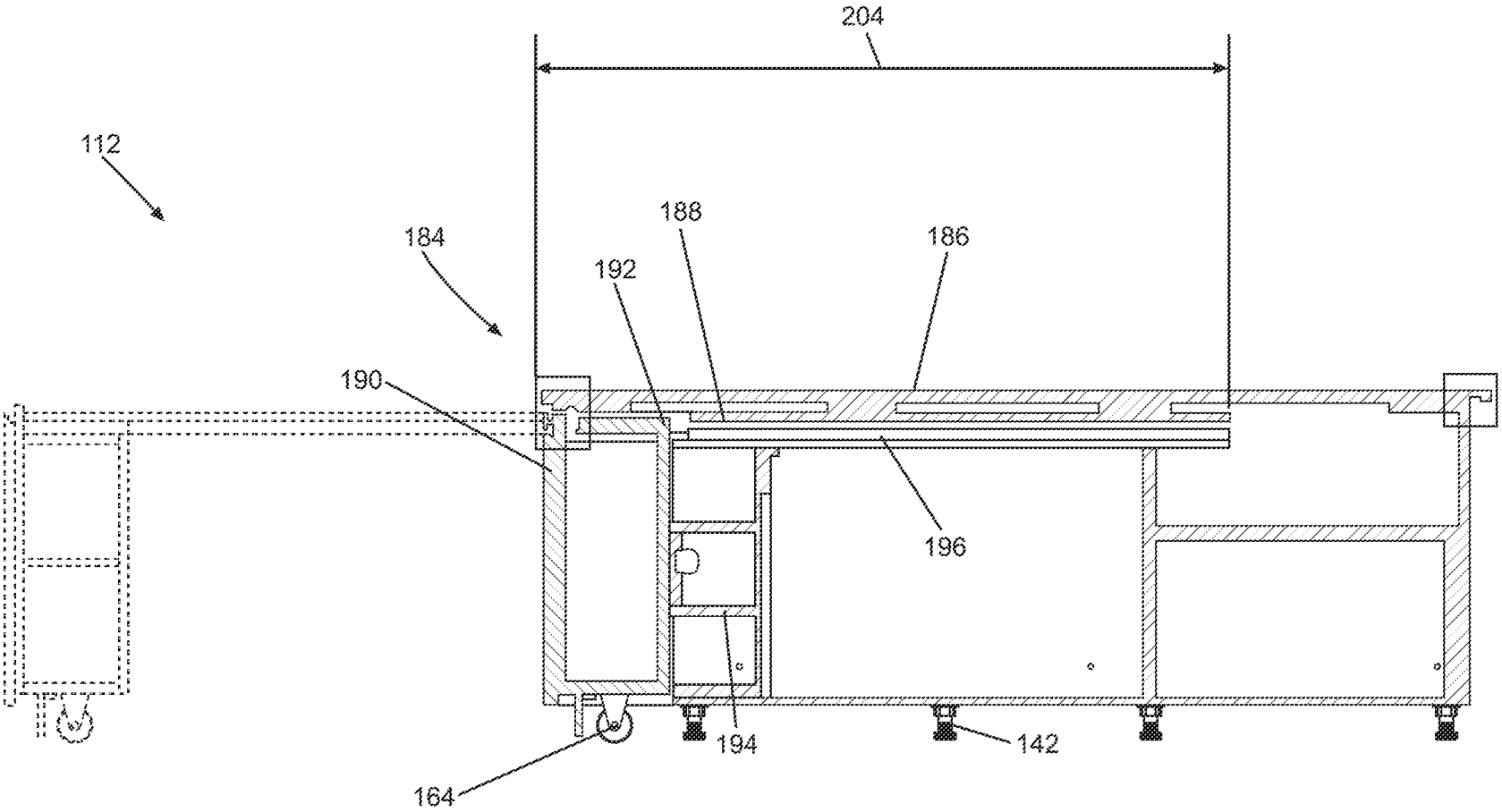
FIG. 11 is a side schematic view of a desk module of the raised bed unit illustrated in FIGS. 1-3 with portions of the movable desk shown in phantom to illustrate the movable desk pulled out of the desk shell in accordance with the present disclosure.
Figure 12:
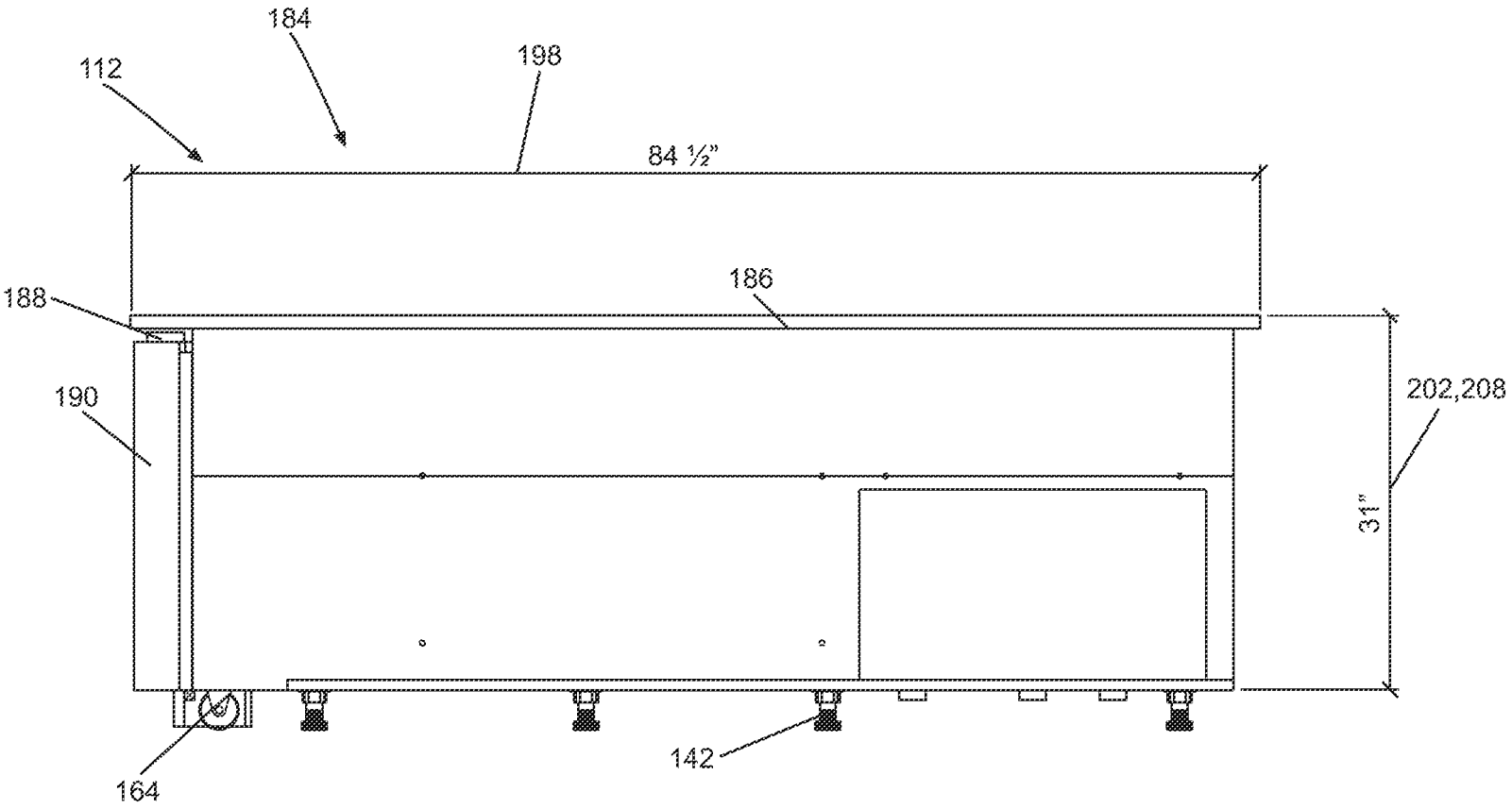
FIG. 12 is another side schematic view of the desk module illustrated in FIG. 11 in accordance with the present disclosure.
Figure 13:
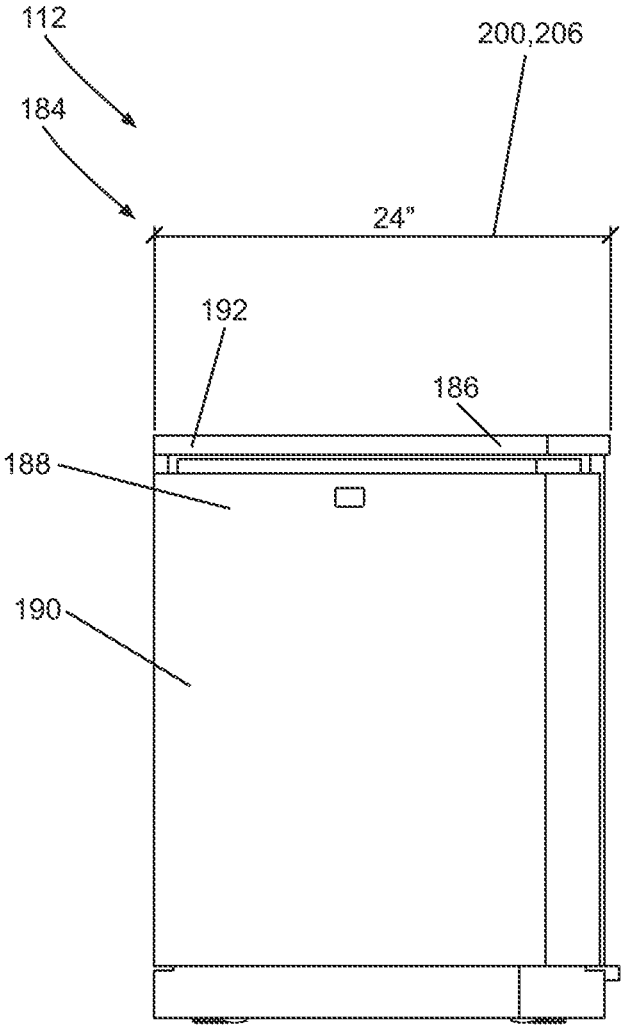
FIG. 13 is a front schematic view of the desk module illustrated in FIGS. 11 and 12 in accordance with the present disclosure.

FIG. 11 is a side schematic view of the desk module 112 with portions of the movable desk 188 shown in phantom to illustrate the movable desk 188 pulled out of the desk shell 186. FIG. 12 is another side schematic view of the desk module 112. FIG. 13 is a front schematic view of the desk module 112. As shown in FIGS. 11-13, the movable desk 188 includes a desk base 190, a desk top 192 extending from the desk base 190, and a plurality of wheels 164 attached to the desk base 190. The desk base 190 may also include a plurality of shelves 194 for additional storage. In the deployed configuration, the desk top 192 is supported by the desk base 190 and the desk shell 186. The desk shell 186 includes a plurality of adjustable feet 142 to support and level the desk shell 186 and a plurality of internal supports 196 configured to support the desk top 192 in the stored configuration and the deployed configuration. Specifically, the desk top 192 is configured to slide in and out of the internal supports 196 when the movable desk 188 is reconfigured between the stored configuration and the deployed configuration.

The desk module 112 has a desk module length 198, a desk module width 200, and a desk module height 202. In the illustrated embodiment, the desk module length 198 is about 84.5 inches, the desk module width 200 is about 24.0 inches, and the desk module height 202 is about 31.0 inches. In alternative embodiments, the desk module length 198, the desk module width 200, and the desk module height 202 may be any lengths that enable the desk module 112 to operate as described herein.

The movable desk 188 has a movable desk length 204, a movable desk width 206, and a movable desk height 208. In the illustrated embodiment, the movable desk length 204 is about 59.75 inches, the movable desk width 206 is about 24.0 inches, and the movable desk height 208 is about 31.0 inches. In alternative embodiments, the movable desk length 204, the movable desk width 206, and the movable desk height 208 may be any lengths that enable the movable desk 188 to operate as described herein.

Figure 14:
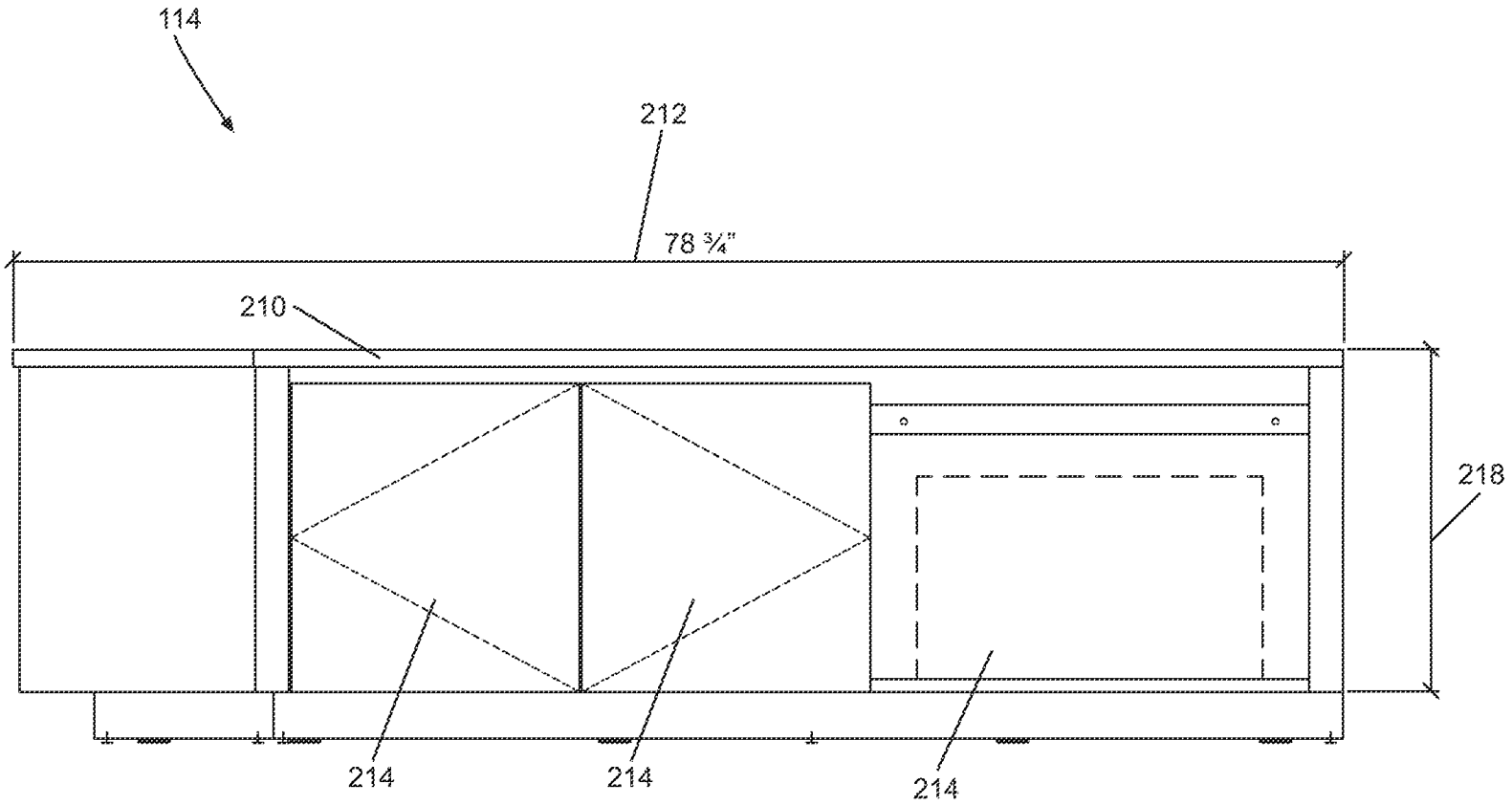
FIG. 14 is a side schematic view of the bench module of the raised bed unit illustrated in FIGS. 1-3 in accordance with the present disclosure.
Figure 15:
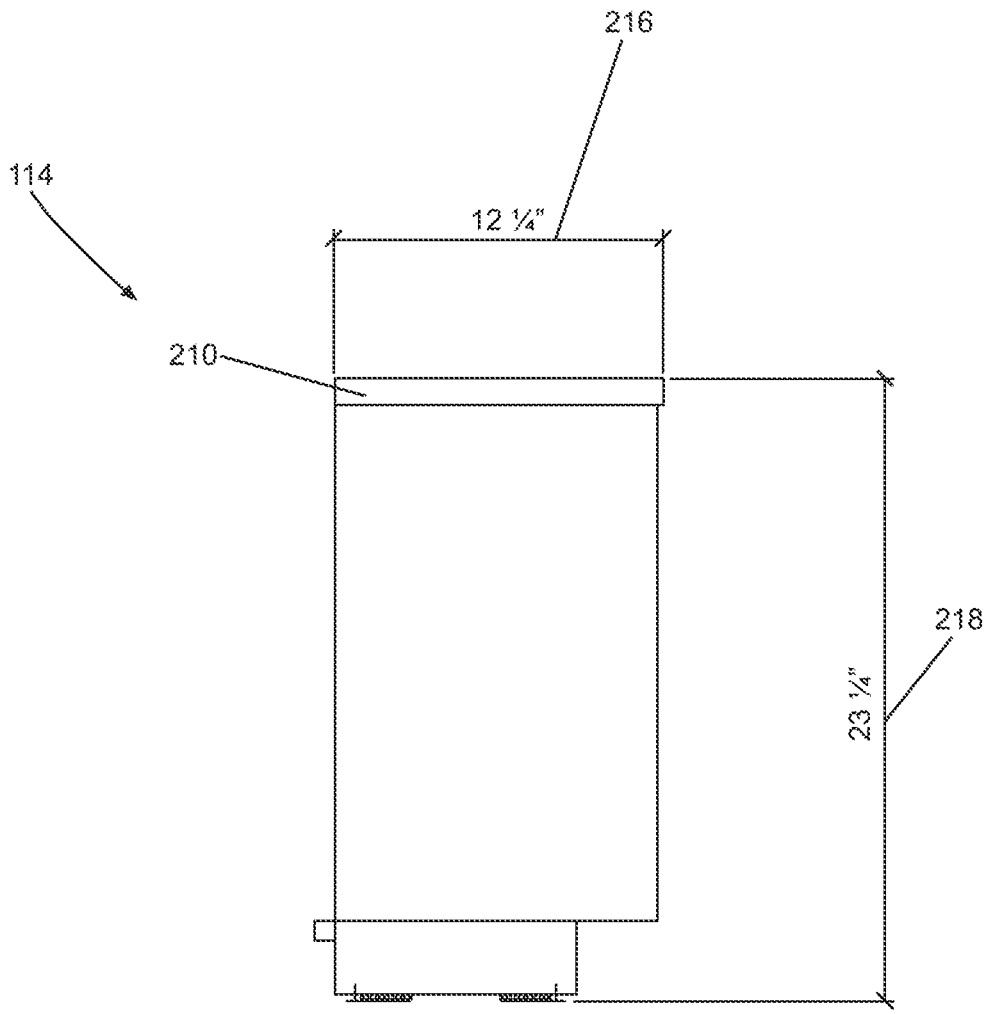
FIG. 15 is a front schematic view of the bench module illustrated in FIG. 14 in accordance with the present disclosure.

FIG. 14 is a side schematic view of the bench module 114. FIG. 15 is a front schematic view of the bench module 114. The bench module 114 is positioned proximate the desk module 112 and the stair module 116 and is attached to the desk module 112 and the stair module 116 for stability. As shown in FIGS. 14 and 15, the bench module 114 defines a bench 210 extending along a bench module length 212 of the bench module 114 and at least one cabinet 214 positioned beneath the bench 210. In the illustrated embodiment, the at least one cabinet 214 includes three cabinets 214 positioned beneath the bench 210. In alternative embodiments, the bench module 114 may include any number of cabinets 214 that enable the bench module 114 to operate as described herein. The bench module 114 has the bench module length 212, a bench module width 216, and a bench module height 218. In the illustrated embodiment, the bench module length 212 is about 78.75 inches, the bench module width 216 is about 12.25 inches, and the bench module height 218 is about 23.25 inches. In alternative embodiments, the bench module length 212, the bench module width 216, and the bench module height 218 may be any lengths that enable the bench module 114 to operate as described herein.

Figure 16:
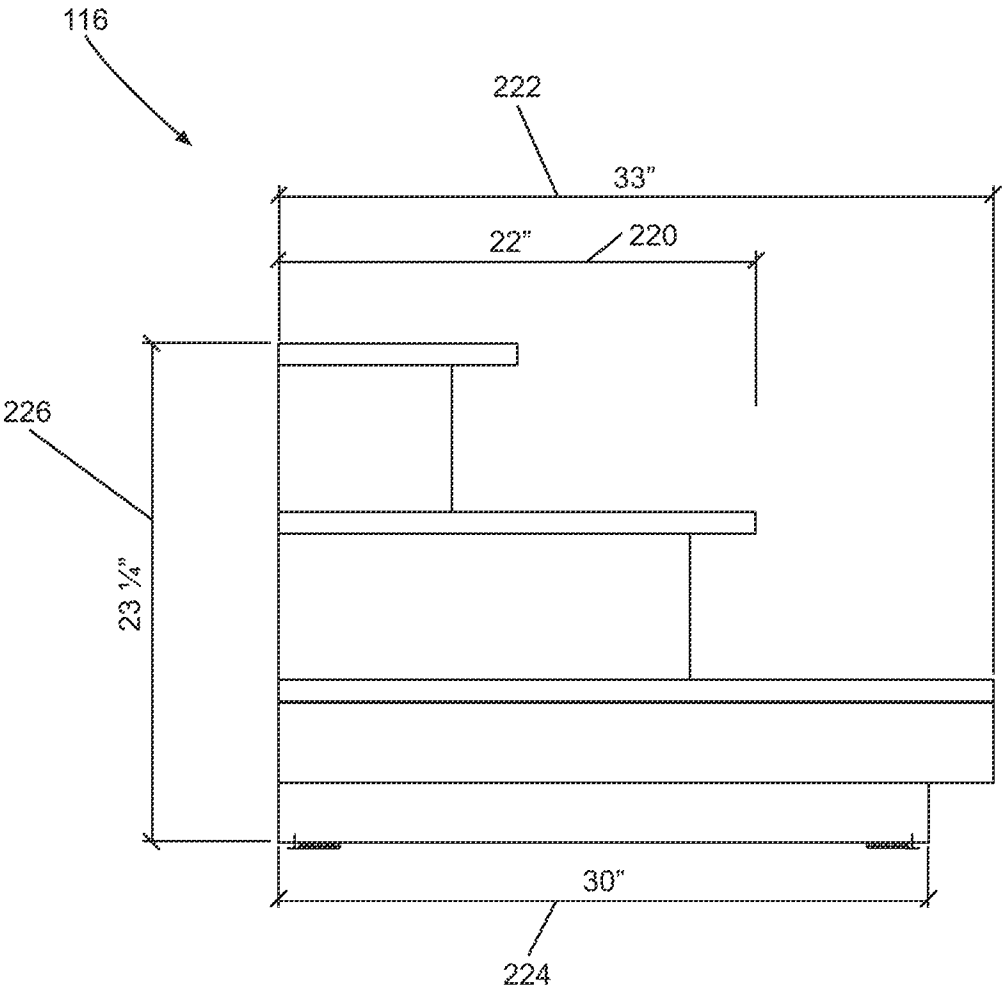
FIG. 16 is a front schematic view of the stair module of the raised bed unit illustrated in FIGS. 1-3 in accordance with the present disclosure.

FIG. 16 is a front schematic view of the stair module 116. The stair module 116 it positioned proximate the desk module 112 and the bench module 114 and is attached to the desk module 112 and the bench module 114 for stability. The stair module 116 defines a plurality of stairs 220 that provide access to the walking path 124. The stair module 116 has a stair module length 222, a stair module width 224, and a stair module height 226. In the illustrated embodiment, the stair module length 222 is about 33 inches, the stair module width 224 is about 33 inches, and the stair module height 226 is about 23.25 inches. In alternative embodiments, the stair module length 222, the stair module width 224, and the stair module height 226 may be any lengths that enable the stair module 116 to operate as described herein.

Figure 17:
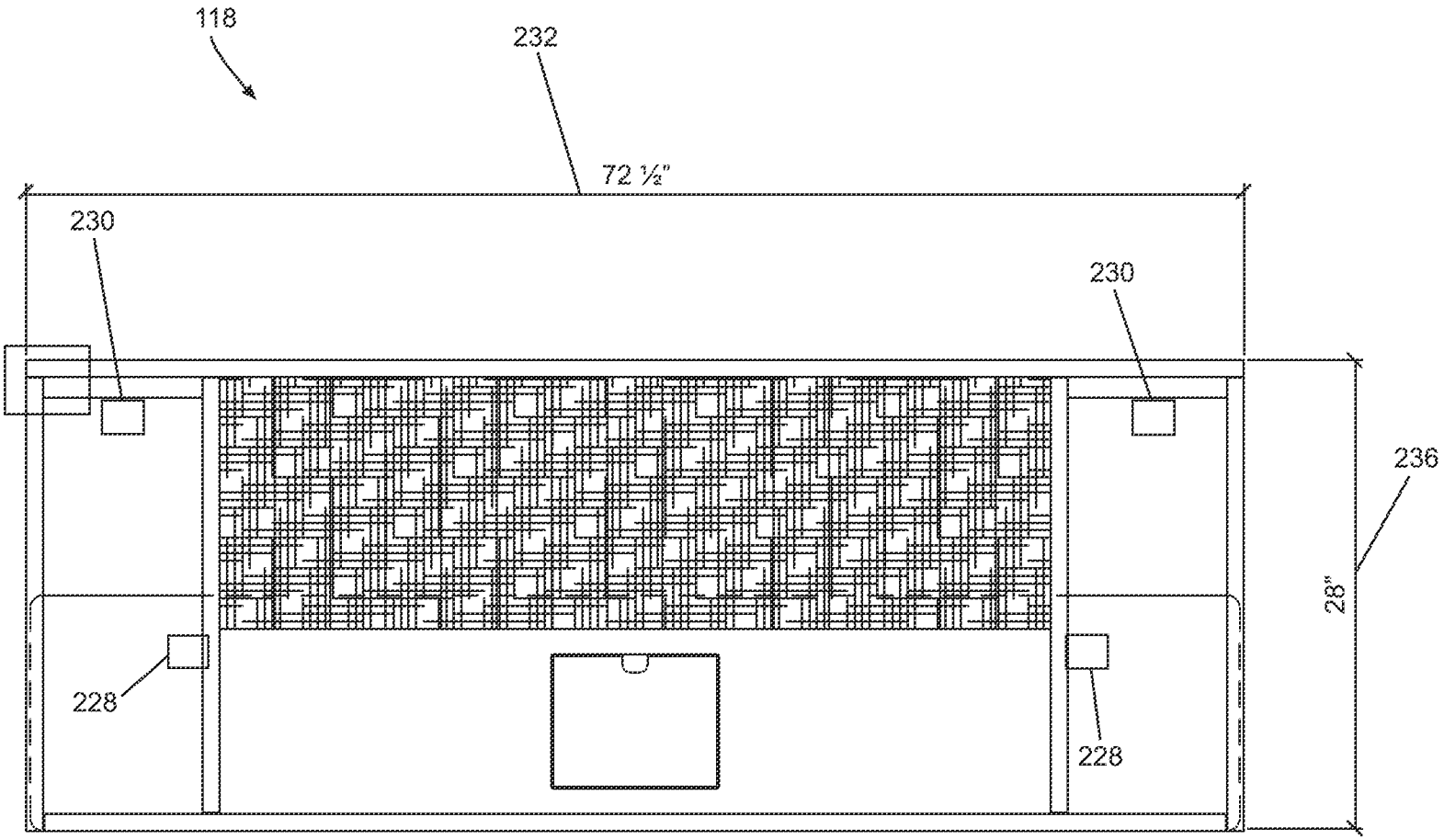
FIG. 17 is a front schematic view of the headboard of the raised bed unit illustrated in FIGS. 1-3 in accordance with the present disclosure.
Figure 18:
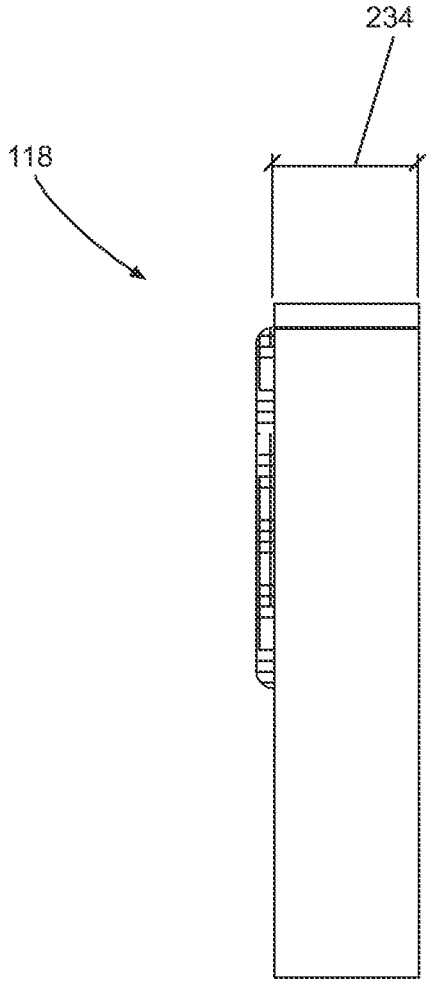
FIG. 18 is a side schematic view of the headboard illustrated in FIG. 17 in accordance with the present disclosure.

FIG. 17 is a front schematic view of the headboard 118. FIG. 18 is a side schematic view of the headboard 118. The headboard 118 is positioned on the raised platform 120 proximate the second wall 107 and is attached to the raised platform 120 for stability. The headboard 118 may also be attached to the second wall 107 for additional stability. The headboard 118 may include electrical outlets 228 and lights 230. The headboard 118 has a headboard length 232, a headboard width 234, and a headboard height 236. In the illustrated embodiment, the headboard length 232 is about 72.5 inches, the headboard width 234 is about 6.75 inches, and the headboard height 236 is about 28.0 inches. In alternative embodiments, the headboard length 232, the headboard width 234, and the headboard height 236 may be any lengths that enable the headboard 118 to operate as described herein.

Figure 19:
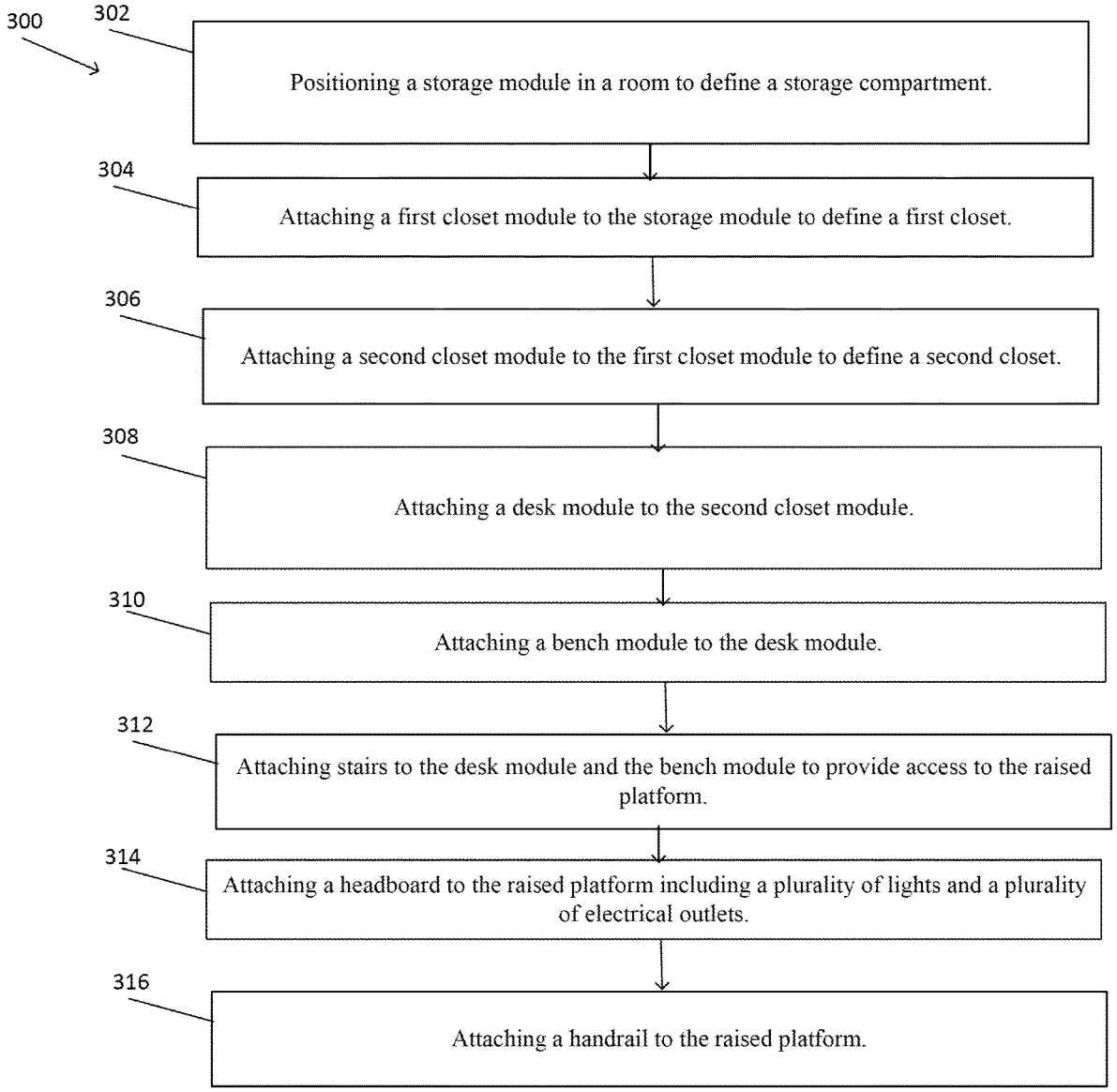
FIG. 19 is a flow diagram of a method of assembling a raised bed system in accordance with the present disclosure.

FIG. 19 is a flow diagram of a method 300 of assembling a raised bed system. The method 300 includes positioning 302 a storage module in a room. The storage module defines a storage compartment. The method 300 also includes attaching 304 a first closet module to the storage module. The first closet module defines a first closet. The method 300 further includes attaching 306 a second closet module to the first closet module. The second closet module defines a second closet. The method 300 also includes attaching 308 a desk module to the second closet module. The desk module includes a movable desk selectively movable between a stored configuration and a deployed configuration. The storage module, the first closet module, the second closet module, and the desk module form a raised platform for supporting a bed.

The method 300 may also attaching 310 a bench module to the desk module. The method 300 may further include attaching 312 stairs to the desk module and the bench module. The stairs provide access to the raised platform. The method 300 may also include attaching 314 a headboard to the raised platform. The headboard includes a plurality of lights and a plurality of electrical outlets. The method 300 may further include attaching 316 a handrail to the raised platform.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A raised bed system comprising:

a plurality of modules assembled to form a raised platform for supporting a bed, the plurality of modules defining a storage area beneath the raised platform and the bed, wherein the plurality of modules comprises:

a closet module defining a closet positioned in the storage area;

a desk module positioned in the storage area and including a movable desk selectively movable between a stored configuration and a deployed configuration;

a bench module attached to the desk module and including a bench; and stairs attached to the desk module and the bench module, wherein the stairs provide access to the raised platform.

2. The raised bed system of claim 1, wherein the closet module comprises a closet shell and a movable closet platform selectively movable between a stored configuration within the closet shell and a deployed configuration out of the closet shell.

3. The raised bed system of claim 2, wherein the movable closet platform comprises a base, a plurality of wheels attached to the base, supports attached to the base, and a closet rod attached to the supports, wherein the plurality of wheels roll the movable closet platform between the stored configuration and the deployed configuration.

4. The raised bed system of claim 3, wherein the movable closet platform further comprises shelves attached to the base and at least one of the supports.

5. The raised bed system of claim 1, wherein the raised platform defines a walking path routed around the bed.

6. The raised bed system of claim 1, wherein the movable desk comprises a desk base, a desk top extending from the desk base, and wheels attached to the desk base, wherein, in the deployed configuration, the desk top is supported by the desk base and the desk module.

7. The raised bed system of claim 1, wherein the closet module comprises a first closet module and the plurality of modules further comprises a second closet module.

8. The raised bed system of claim 7, wherein the second closet module comprises a second closet shell and a second movable closet platform selectively movable between a stored configuration within the second closet shell and a deployed configuration out of the second closet shell.

9. The raised bed system of claim 8, wherein the second movable closet platform comprises a second base, a second plurality of wheels attached to the second base, second supports attached to the second base, and a second closet rod attached to the second supports, wherein the second wheels roll the second movable closet platform between the stored configuration and the deployed configuration.

10. The raised bed system of claim 9, wherein the second movable closet platform further comprises second shelves attached to the second base and at least one of the second supports.

11. The raised bed system of claim 1, wherein the plurality of modules further comprises a storage module defining a storage compartment.

12. The raised bed system of claim 1, wherein the bench module comprises a plurality of cabinets positioned beneath the bench.

13. The raised bed system of claim 1, further comprising a headboard comprising a plurality of lights and a plurality of electrical outlets.

14. A method of assembling a raised bed system comprising:

positioning a storage module in a room, the storage module defining a storage compartment;

attaching a first closet module to the storage module, the first closet module defining a first closet;

attaching a second closet module to the first closet module, the second closet module defining a second closet;

attaching a desk module to the second closet module, the desk module comprising a movable desk selectively movable between a stored configuration and a deployed configuration, wherein the storage module, the first closet module, the second closet module, and the desk module form a raised platform for supporting a bed;

attaching a bench module to the desk module; and attaching stairs to the desk module and the bench module, wherein the stairs provide access to the raised platform.

15. The method of claim 14, further comprising attaching a headboard to the raised platform, wherein the headboard includes a plurality of lights and a plurality of electrical outlets.

16. The method of claim 14, further comprising attaching a handrail to the raised platform.

* * * * *